US010723495B2

(12) United States Patent
Jordà Boldú et al.

(10) Patent No.: US 10,723,495 B2
(45) Date of Patent: Jul. 28, 2020

(54) BAG OPENING DEVICE FOR FORM-FILL-SEAL MACHINES

(71) Applicant: PAYPER, S.A., Lleid (EE)

(72) Inventors: Daniel Jordà Boldú, Lleida (ES); Josep Maria Ribalta Ferrer, Lleida (ES)

(73) Assignee: PAYPER, S.A., Lleida (ES)

( * ) Notice: Subject to any disclaimer, the term of this patent is extended or adjusted under 35 U.S.C. 154(b) by 137 days.

(21) Appl. No.: 15/820,735

(22) Filed: Nov. 22, 2017

(65) Prior Publication Data

US 2018/0141691 A1 May 24, 2018

(30) Foreign Application Priority Data

Nov. 22, 2016 (EP) ..... 16382543

(51) Int. Cl.
*B65B 43/30* (2006.01)
*B65B 65/02* (2006.01)

(52) U.S. Cl.
CPC ..... *B65B 43/30* (2013.01); *B65B 65/02* (2013.01)

(58) Field of Classification Search
CPC ..... B65B 43/26; B65B 43/30
USPC ..... 53/384.1, 386.1
See application file for complete search history.

(56) References Cited

U.S. PATENT DOCUMENTS 3,501,893 A * 3/1970 Peterson ..... B65B 43/30 53/386.1
3,688,471 A 9/1972 Clark
4,300,600 A * 11/1981 Tetenborg ..... B65B 39/08 53/502
4,563,864 A * 1/1986 Eschmann ..... B65B 39/08 53/570
5,375,396 A * 12/1994 Huwelmann ..... B65B 43/54 53/570
5,448,879 A * 9/1995 Concetti ..... B65B 1/02 53/570
5,979,512 A * 11/1999 McGregor et al. ..... B65B 43/30 141/10
6,138,723 A * 10/2000 Wagner ..... B65B 43/465 53/570
6,401,439 B1 * 6/2002 Tetenborg et al. ... B65B 43/465 53/570

(Continued)

FOREIGN PATENT DOCUMENTS

EP 0001025 A1 3/1979
JP 06122422 A * 5/1994

OTHER PUBLICATIONS

European Search Report for corresponding application EP 16 38 2543; Report dated May 29, 2017.

*Primary Examiner* — Stephen F. Gerrity
(74) *Attorney, Agent, or Firm* — Cantor Colburn LLP

(57) ABSTRACT

A bag opening device for a form-fill-seal machine includes two coupling modules for being coupled to each side of a bag for opening the bag. The coupling modules are movable with respect to one another between an open position and a closed position by a driving component. The driving component of the coupling modules includes a motor driving the movement of one of the coupling modules and a synchronizing connecting rod synchronizing the movement of the coupling module driven by the motor with the other coupling module. The bag opening device allows a higher form-fill-seal speed than with conventional form-fill-seal machines.

10 Claims, 4 Drawing Sheets

(56) References Cited

U.S. PATENT DOCUMENTS

| | | | | |
|---|---|---|---|---|
| 2007/0074492 | A1* | 4/2007 | Koga et al. | B65B 43/36 53/570 |
| 2014/0331603 | A1 | 11/2014 | Takahashi | |
| 2015/0266601 | A1 | 9/2015 | Vollenkemper | |
| 2018/0215489 | A1* | 8/2018 | Gallaun et al. | B65B 43/30 |

* cited by examiner

BAG OPENING DEVICE FOR FORM-FILL-SEAL MACHINES

CROSS REFERENCE TO RELATED APPLICATION

This application is related to and claims the benefit of European Patent Application Number 16382543.3 filed on Nov. 22, 2016, the contents of which are herein incorporated by reference in their entirety.

TECHNICAL FIELD

The present invention relates to a bag opening device for form-fill-seal machines, which allows a higher form-fill-seal speed than in conventional form-fill-seal machines.

BACKGROUND OF THE INVENTION

Form-fill-seal machines, referred to as FFS machines, using a tubular reel of plastic material are known, in which a bag of a given length is formed, filled with a product and closed or sealed once it is filled.

One of the most important work stations in these form-fill-seal machines is the fill station, in which the bag previously formed in a previous station and transferred to the fill station by conveyance means is opened at the upper part to allow the bag fill nozzle to enter the bag and discharge a pre-prepared product through a passage formed by blades of the nozzle as they open.

One of the problems these machines typically have is that of increasing the working capacity of the form-fill-seal machine, which is limited, although not exclusively, by the fill station. The faster the transfer of the empty bag formed in the bag fill nozzle station is, and the faster the means intended for opening the mouth of the bag for introducing the bag fill nozzle into the bag and discharging the product are, the higher the working speed, and therefore the production capacity of the form-fill-seal machine, can be.

The bag opening device typically used for opening the mouth of the bag comprises suction cups connected to a vacuum generating device, arranged on an articulation device which basically allows effecting two movements.

In a first movement, the suction cups are raised above the upper edge of the bag while the empty bag is conveyed under the bag fill nozzle and/or the filled bag is conveyed to the next station for closing or sealing the mouth of the bag, preventing the upper part of the bag from colliding with these suction cups during the movements for transferring bags between stations.

In a second movement, the suction cups are in the open position (and their upper edge is therefore below the level of the upper edge of the bag) for separating the two faces forming the tubular reel, and allowing the entry of the articulated blades of the nozzle into the bag.

This second movement basically consists of moving the suction cups closer until they come into contact with the two faces of the tubular reel, applying a vacuum to hold them, and when the suction cups are separated from one another again, pulling the two tubular faces using the effect of the strength of the vacuum, opening the mouth of the bag.

The movements of the suction cups for moving them up and down with respect to the horizontal plane defined by the upper edge of the bag, as well as for moving the suction cups closer together and separating them and for effecting the movement of opening the mouth of the bag, are typically done with mechanical devices operated by means of pneumatic elements: pneumatic cylinders or pneumatic actuators.

One of the drawbacks of using these devices controlled by means of pneumatic drives for effecting the movements of the suction cups is their limitation in controlling speeds in each of the steps of the process of opening the mouth of the bag, because when the sudden stops upon reaching the end positions cause vibrations and shaking.

These vibrations and shaking have an effect on the reliability of the process of opening the mouth of the bag and limit the maximum working speed of this opening device for opening the mouth of the bag.

These limitations in the precise control of the driving speed of the movements of the suction cups are not only important in the end positions, but also in the intermediate positions of the work cycle of the suction cups.

For example, it is important for improving the working reliability of the device that when the suction cups are separated from one another to open the mouth of the bag, they move at a controlled speed, for example, a slower speed, to allow the entry of air between the two faces of the bag, and/or they overcome the attractive pull due, for example, to static electricity impeding separation of these two faces, and a faster speed, when the two faces of the bag have already started to separate and the separation thereof can be accelerated for reducing bag preparation time before opening the bag fill nozzle.

Therefore, the purpose of the present invention is to overcome the limitations existing in devices known today with pneumatic drive controls which do not allow working with high bag opening speeds.

The opening device according to the present invention can obtain, with the required reliability, high-speed working of these form-fill-seal machines, for example, at form-fill-seal speeds between about 2,400 and 2,750 cycles per hour.

DESCRIPTION OF THE INVENTION

The opening device of the invention solves the aforementioned drawbacks and has other advantages that will be described below.

The bag opening device according to the present invention is described in the claims. Optional features are described in the dependent claims.

The bag opening device for a form-fill-seal machine according to the present invention comprises two coupling modules for being coupled to each side of a bag for opening same, said coupling modules being movable with respect to one another between an open position and a closed position by driving means, and characterized in that said driving means of the coupling modules comprise a motor driving the movement of one of the coupling modules and a synchronizing connecting rod synchronizing the movement of the coupling module driven by the motor with the other coupling module.

Preferably, said driving means also comprise first and second driving levers, each integral with a shaft for moving each of said coupling modules.

According to a first embodiment, said first and second cranks are connected to one another by means of said synchronizing connecting rod, whereas a connecting rod-crank mechanism is used for transmitting the rotational movement of the motor to the first of the driving levers.

This preferred connecting rod-crank solution has the advantage that at the end positions of said coupling modules, i.e., when the coupling modules are placed in the closed position, such that the coupling elements are coupled with two opposite edges of a bag, and when the coupling modules are separated from one another to their open position, thereby separating the opposite edges of the bag, the drive mechanism transmitting rotational movement is in the two characteristic dead center positions of the mechanism. In these dead center positions, the end positions of the driving levers and their respective coupling modules are reached, the latter remain momentarily stopped before the direction of the movement is reversed, vibrations at the two ends, and especially the possibility of the coupling modules colliding with one another in the closed position, particularly when working at high speeds for opening the mouth of the bag, being reduced.

Each coupling module advantageously comprises at least one swinging arm swinging between said open and closed positions, and each coupling module comprises at least one coupling element movable between a use position and a standby position by movement means. Furthermore, the coupling element of each coupling module is mounted at the distal end of said swinging arm.

According to a preferred embodiment, each coupling module comprises at least one suction cup as a coupling element.

According to a second embodiment, said first and second driving levers are connected by means of the synchronizing connecting rod, and one of the driving levers rotates integrally with the output shaft of the motor by means of a belt.

Advantageously, said motor can be a servomotor, although it could be also a conventional motor.

Furthermore, said movement means can be pneumatic movement means or comprise at least one servomotor.

As a result of this configuration of the driving means, the form-fill-seal machine can work at a higher speed than conventional form-fill-seal machines, and always with the required reliability.

BRIEF DESCRIPTION OF THE DRAWINGS

To better understand the preceding description, a set of drawings is attached in which a practical embodiment is schematically depicted by way of non-limiting example.

DESCRIPTION OF A PREFERRED EMBODIMENT

Figure 1:
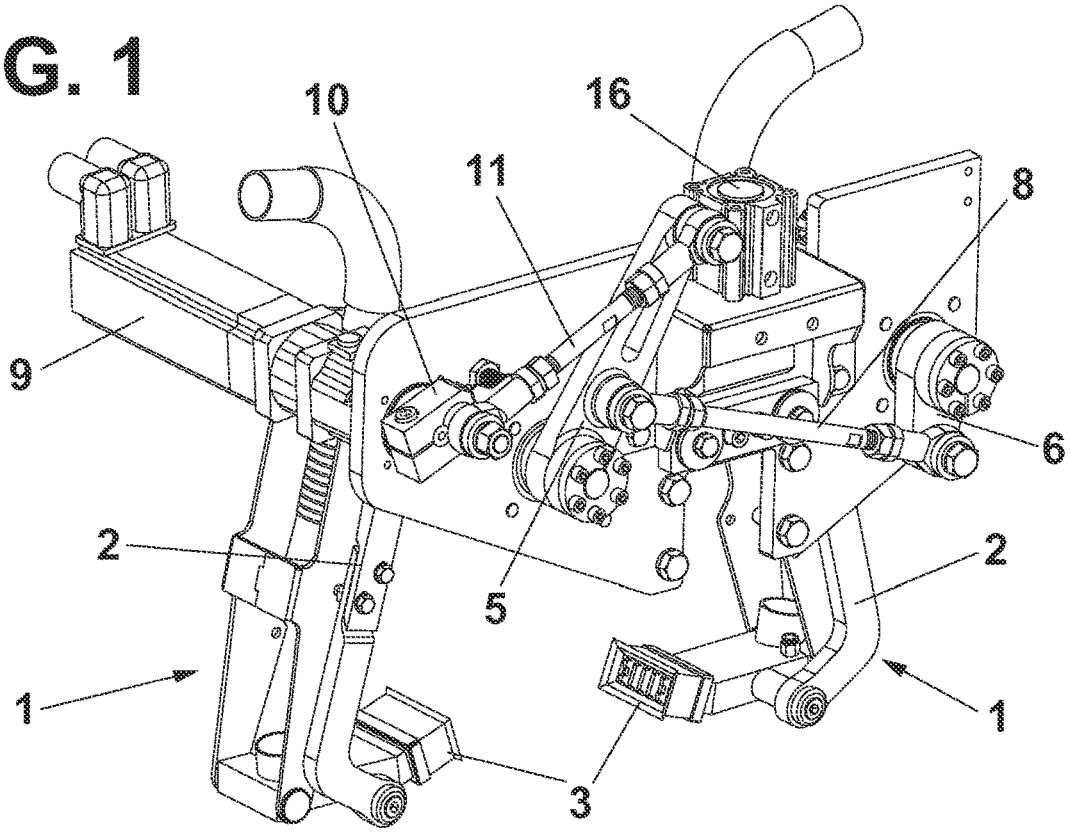
FIG. 1 is a perspective view of the bag opening device according to the present invention with the coupling modules in the open position and the coupling elements in the standby position.
Figure 2:
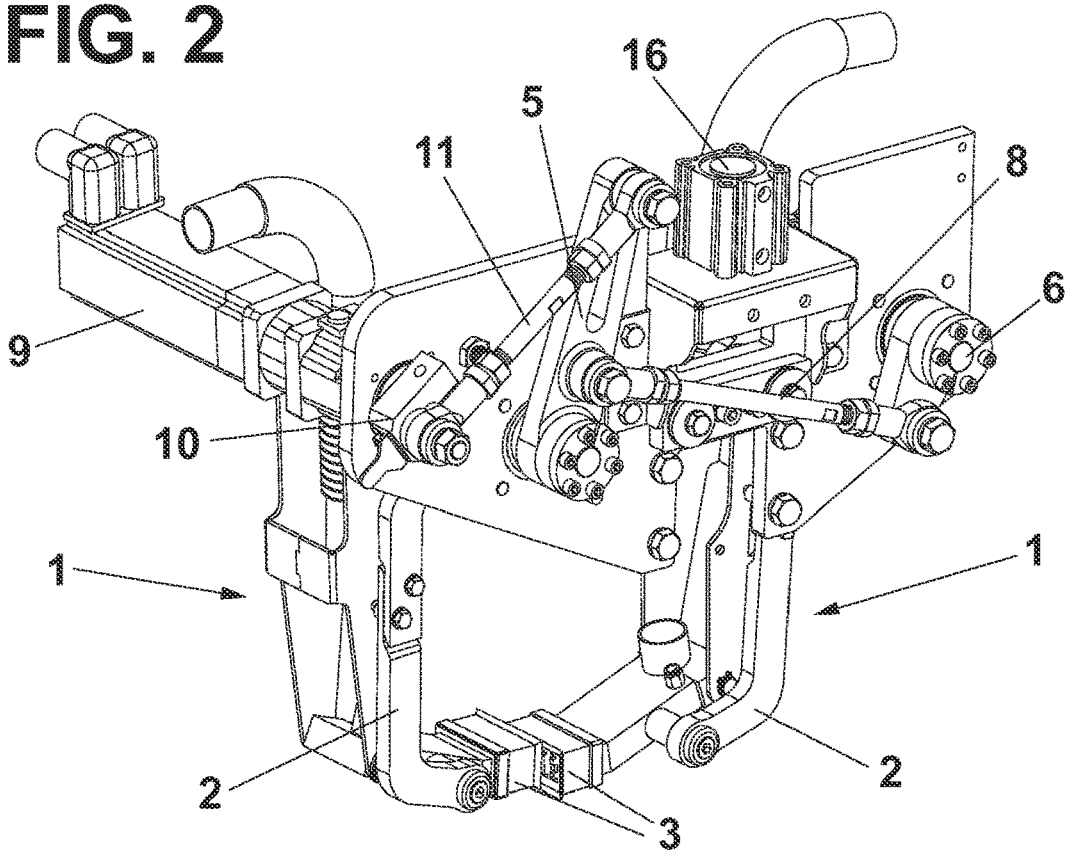
FIG. 2 is a perspective view of the bag opening device according to the present invention with the coupling modules in the closed position and the coupling elements in the use position.
Figure 3:
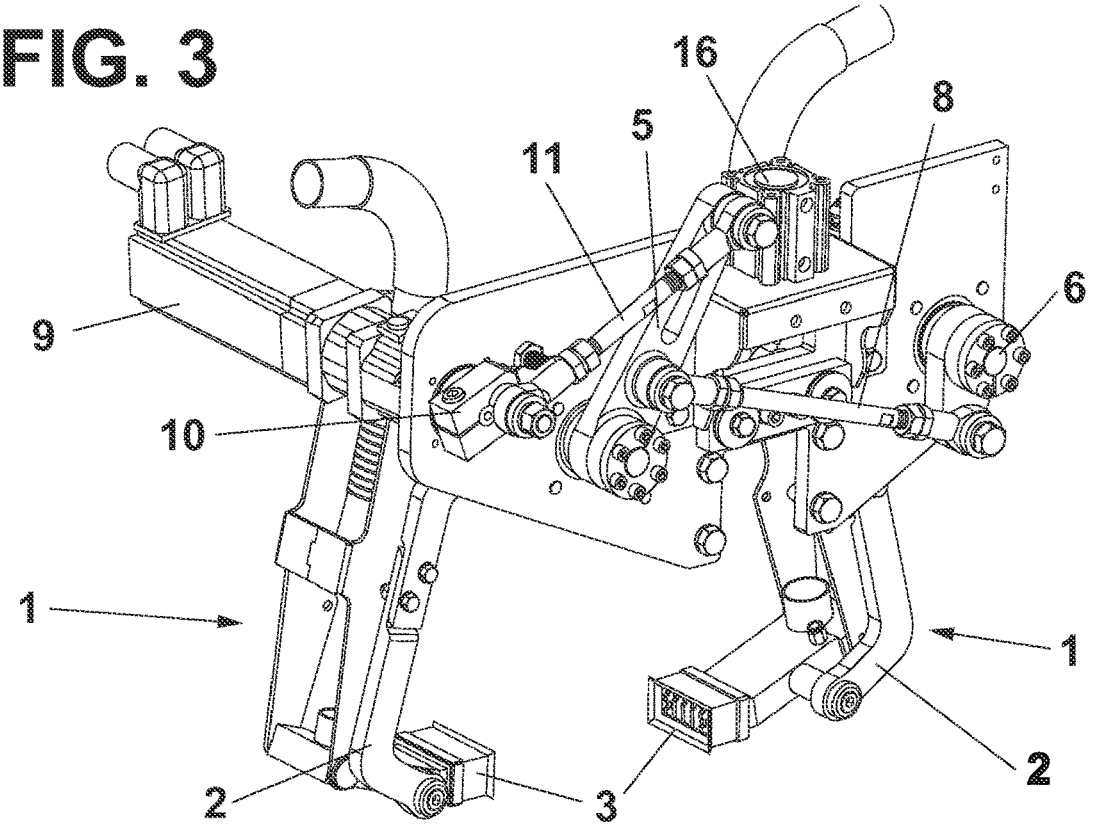
FIG. 3 is a perspective view of the bag opening device according to the present invention with the coupling modules in the closed position and the coupling elements in the use position.

FIGS. 1 to 3 show the bag opening device according to the present invention in three different positions, which will be explained below.

The opening device comprises two coupling modules, generally indicated by means of reference number 1, each of which is coupled to one end of a bag for opening it to allow filling the bag with a suitable product.

In order to allow said opening of the bag, the coupling modules 1 are movable with respect to one another between an open position (shown in FIGS. 1 and 3) and a closed position (shown in FIG. 2).

Each coupling module 1 comprises at least one swinging arm 2 provided at its distal end, i.e., the end farthest away from its swinging shaft, with at least one coupling element 3, for example, with at least one suction cup, according to a preferred embodiment.

Each coupling element 3 is movable between a standby position (shown in FIG. 1) and a use position (shown in FIGS. 2 and 3) by movement means.

The movement means for moving the coupling elements 3 preferably comprise an articulated parallelogram which raises the coupling elements 3 with respect to the horizontal position they have when they move closer to the bag (use position) and are separated from one another to effect the opening. Once the coupling elements 3 are separated and once the bag fill nozzle has entered the bag, said coupling elements 3 swing to a position (standby position) where they occupy a higher position with respect to the horizontal plane defined by the mouth of the bag, in order to allow the entry of a new empty bag without colliding or interfering with same. This movement is driven by means of a pneumatic cylinder 16.

The movement of the coupling modules 1 between the open and closed positions, and vice versa, is performed by driving means, driven by a motor 9, preferably a servomotor.

According to the first embodiment depicted in FIGS. 1 to 6, said driving means comprise first and second driving levers 5, 6, each integral with a shaft for moving, specifically rotating, each of said coupling modules 1.

Furthermore, said first and second driving levers 5, 6 are connected to one another by means of said synchronizing connecting rod 8. The rotational movement of the motor 9 is transmitted to the first of the driving levers 5 by means of a connecting rod-crank mechanism 10, 11, the two ends of the connecting rod 11 being attached to the crank 10 and to the driving lever 5, respectively.

The corresponding arrows have been depicted in FIG. 1 to help understand the movement of these driving means.

Figure 4:
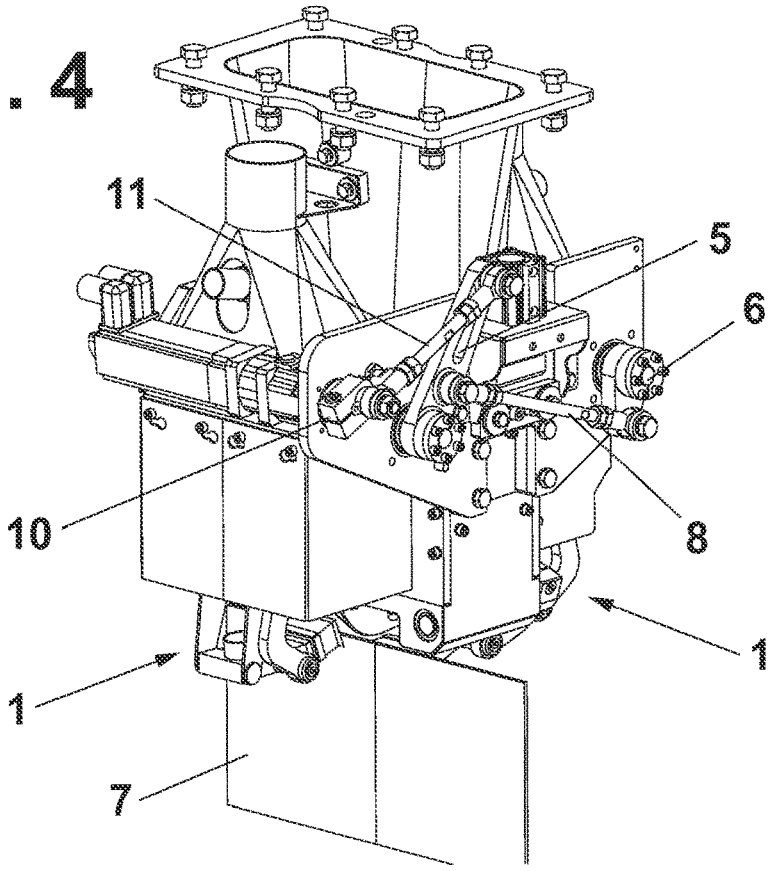
FIGS. 4 to 6 are perspective views showing a cycle for opening a bag with the bag opening device according to the present invention.
Figure 5:
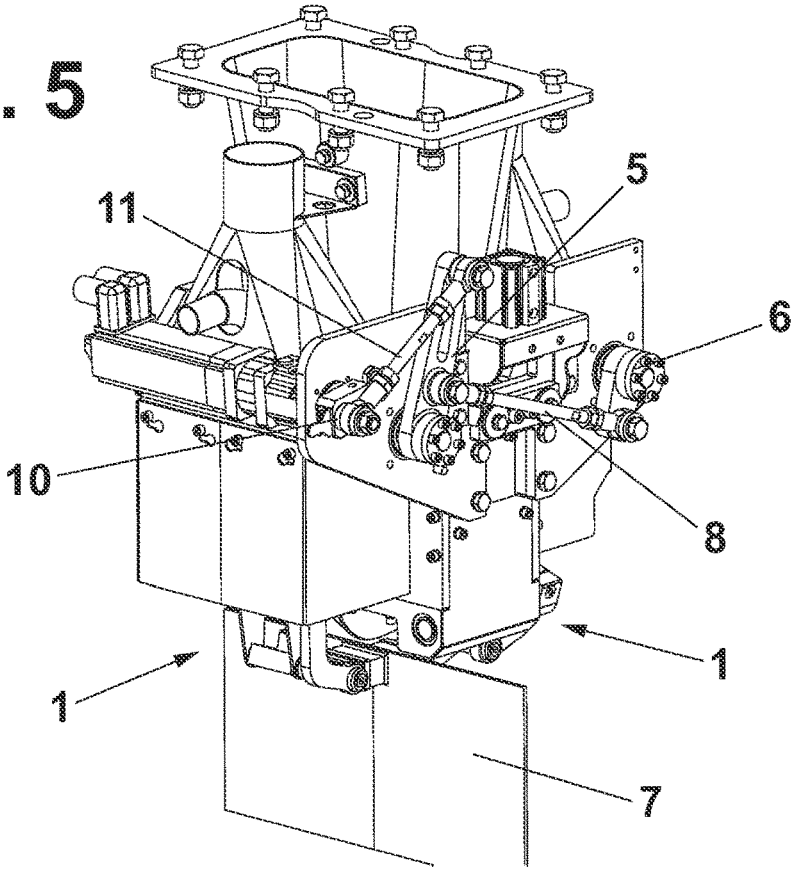
Figure 6:
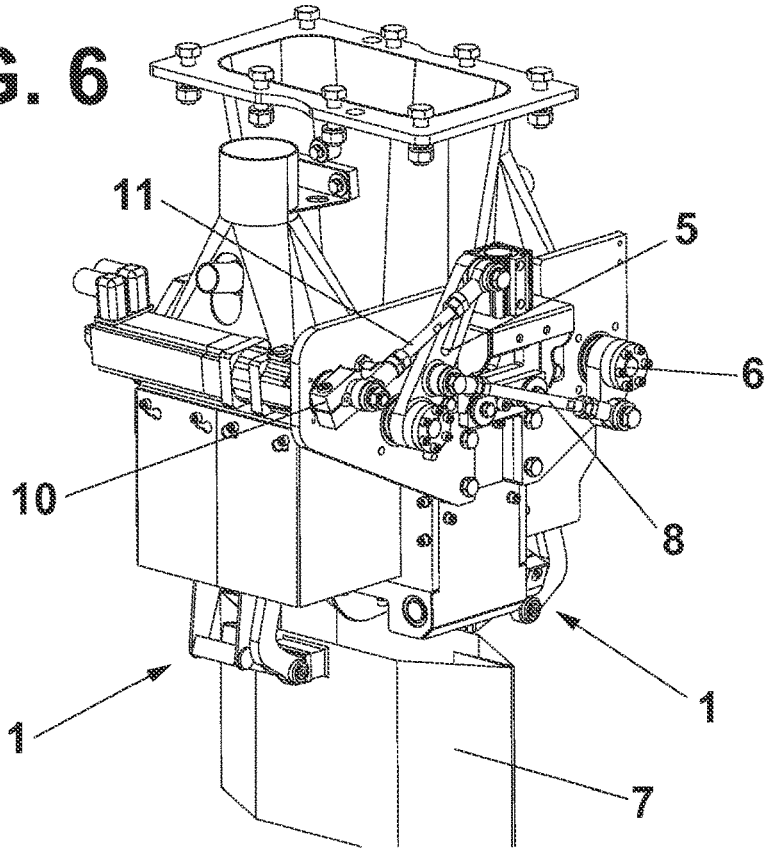

The process of opening the bag can be seen in FIGS. 4 to 6.

FIG. 4 shows the bag opening device according to the present invention with the coupling modules in the open position and the coupling elements in the standby position.

Furthermore, this figure shows a closed bag placed in its initial position prior to being opened. It should be indicated that the placement of this bag 7 in this position can be done by conventional means known by a person skilled in the art, and this part of the fill-form-seal process is not part of the opening device according to the present invention. Therefore, it is considered unnecessary to describe them for the sake of simplicity.

From this position, the coupling elements 3, such as suction cups, are placed in their use position, as can be seen in FIG. 5, and next the coupling modules 1 are also placed in the closed position, such that the coupling elements 3 are coupled with two opposite edges of a bag 7.

Then the coupling modules 1 are separated from one another to the open position, thereby separating opposite edges of the bag 7, such that the bag 7 is open, ready to be filled with the desired products, as can be seen in FIG. 6.

In this position, the bag 7 is filled through a fill nozzle (not depicted) of the form-fill-seal machine, and once filling is done, this mouth is closed to allow the filled bag to leave and the new empty bag to enter this fill station.

Furthermore, before removing the bag 7 the coupling elements 3 are placed in the standby position to allow the removal thereof.

It should be indicated that the means for carrying out the process of filling and removing the bag 7 are not part of the present invention, and that conventional means known by the person skilled in the art can be used. Therefore, it is considered unnecessary to describe them for the sake of simplicity.

It should also be indicated that even though all the steps of the process of opening a bag have been explained sequentially in the present description for the sake of clarity, it is obvious that the form-fill-seal process, including opening the bags, is performed continuously at a very high speed, a production of between about 2,400 and 2,750 cycles per hour being achieved using the opening device according to the present invention.

Figure 7:
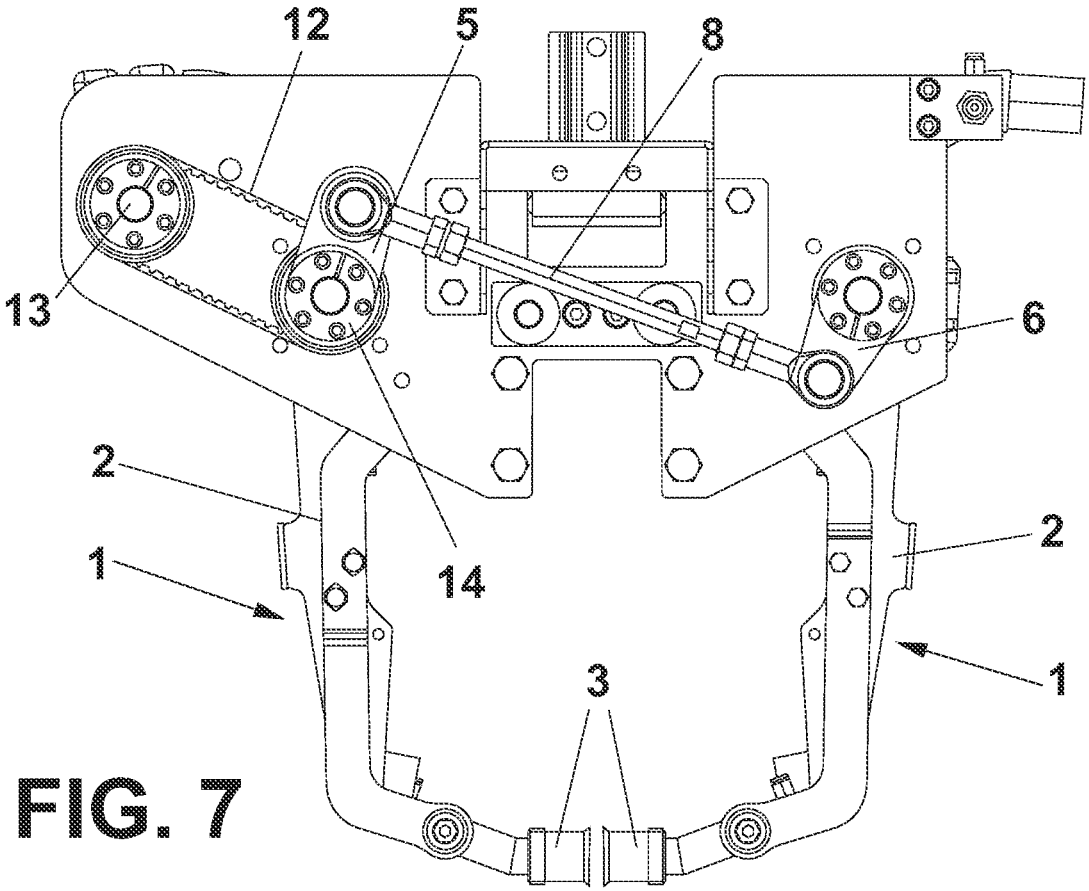
FIG. 7 is a front view of the bag opening device of the present invention according to a second embodiment.

FIG. 7 shows a second embodiment of the driving means of the coupling modules 1.

For the sake of simplicity, in this second embodiment the same reference numbers are used to indicate the same elements as in the first embodiment. It should also be indicated that the only difference with respect to the first embodiment are the driving means, the remaining elements being the same.

In this embodiment, the driving means also comprise first and second driving levers 5, 6 which are connected to one another by means of the synchronizing connecting rod 8, and one of said cranks 5 rotates integrally with the output shaft of the motor 9 by means of a transmission mechanism formed by two pulleys 13, 14, and a transmission belt 12 for transmitting movement between both, one of the pulleys 13 being integral with the output shaft of the motor 9, and the other pulley 14 being integral with the shaft of the first of the driving levers 5.

In this case, the drive from the motor 9 is performed by means of a transmission pulley 13 integral with the output shaft of the motor 9, and a synchronous belt 12 acting like a transmission between this first pulley 13 and the pulley 14 integral with the shaft for rotating the first of the transmission levers 5. Also in this case, the motor 9 is preferably a servomotor.

It should be indicated that the process of opening the bags is the same as the process described above in relation to the first embodiment.

Although reference has been made to a specific embodiment of the invention, it is obvious for a person skilled in the art that the described bag opening device is susceptible to a number of variations and modifications and that all the mentioned details can be replaced with other technically equivalent ones without departing from the scope of protection defined by the attached claims.

The invention claimed is:

1. A bag opening device for a form-fill-seal machine, comprising:

two coupling modules for being coupled to each side of a bag for opening same, said coupling modules being movable with respect to one another between an open position and a closed position by driving means;

wherein said driving means of the coupling modules comprise a motor driving movement of one of the coupling modules and a synchronizing connecting rod synchronizing movement of the coupling module driven by the motor with the other coupling module;

wherein said driving means also comprise first and second driving levers, each driving lever integral with a shaft for moving each of said coupling modules, respectively;

wherein said first and second driving levers are connected to one another by said synchronizing connecting rod;

wherein one of said first and second driving levers is connected to an output shaft of the drive motor by a crank and second connecting rod;

wherein the second connecting rod has first and second ends; and wherein the first and second ends of the second connecting rod are attached to the crank and to the one of said first and second driving levers, respectively.

2. The bag opening device for a form-fill-seal machine according to claim 1, wherein each coupling module comprises at least one swinging arm swinging between said open and closed positions.

3. The bag opening device for a form-fill-seal machine according to claim 2, wherein a coupling element of each coupling module is mounted at a distal end of said swinging arm.

4. The bag opening device for a form-fill-seal machine according to claim 1, wherein each coupling module comprises at least one coupling element movable between a use position and a standby position by movement means.

5. The bag opening device for a form-fill-seal machine according to claim 4, wherein said movement means comprises at least one servomotor.

6. The bag opening device for a form-fill-seal machine according to claim 4, wherein the movement means is configured for moving the coupling elements and comprises an articulated parallelogram adapted to move the coupling elements from a standby position to a use position, and from the use position to the standby position.

7. The bag opening device for a form-fill-seal machine according to claim 4, wherein the movement means for moving the coupling elements comprise a pneumatic cylinder.

8. The bag opening device for a form-fill-seal machine according to claim 1, wherein each coupling module comprises at least one suction cup as a coupling element.

9. The bag opening device for a form-fill-seal machine according to claim 1, wherein said motor is a servomotor.

10. A bag opening device for a form-fill-seal machine, comprising:

two coupling modules for being coupled to each side of a bag for opening same, said coupling modules being movable with respect to one another between an open position and a closed position by driving means;

wherein said driving means of the coupling modules comprise a motor driving the movement of one of the coupling modules and a synchronizing connecting rod synchronizing the movement of the coupling module driven by the motor with the other coupling module;

wherein said driving means also comprise first and second driving levers, each driving lever integral with a shaft for moving each of said coupling modules, respectively;

wherein the first and second driving levers are connected by the synchronizing connecting rod; and wherein the first driving lever rotates integrally with an output shaft of the motor by a transmission mechanism formed by first and second pulleys, and a transmission belt for transmitting movement between the first and second pulleys, the first pulley being integral with the output shaft of the motor, and the second pulley being integral with the shaft of the first driving lever.

* * * * *